US005734161A

United States Patent [19]

Köster

[11] Patent Number: 5,734,161

[45] Date of Patent: Mar. 31, 1998

[54] METHOD FOR TIME-OF-FLIGHT MASS SPECTROMETRY OF DAUGHTER IONS

[75] Inventor: Claus Köster, Lilienthal, Germany

[73] Assignee: Bruker-Franzen Analytik, GmbH, Bremen, Germany

[21] Appl. No.: 757,895

[22] Filed: Nov. 27, 1996

[30] Foreign Application Priority Data

Dec. 1, 1995 [DE] Germany ..... 195 44 808.1

[51] Int. Cl.[6] ..... H01J 49/40

[52] U.S. Cl. ..... 250/287; 250/282

[58] Field of Search ..... 250/287, 282

[56] References Cited

U.S. PATENT DOCUMENTS

| | | | |
|---|---|---|---|
| 4,818,862 | 4/1989 | Conzemius | 250/287 |
| 5,073,713 | 12/1991 | Smith et al. | 250/282 |
| 5,625,184 | 4/1997 | Vestal et al. | 250/287 |
| 5,641,959 | 6/1997 | Holle et al. | 250/287 |

FOREIGN PATENT DOCUMENTS

| | | |
|---|---|---|
| 0403965 | 6/1990 | European Pat. Off. . |
| 63-245850 | 10/1988 | Japan . |
| 1410315 | 1/1974 | United Kingdom . |

OTHER PUBLICATIONS

Rong Feng, et al., *An Improved Double–Focusing Mass Spectrometer For Neutralization–Reionization and Collisonal Activation Studies*, International Journal of Mass Spectrometry and Ion Processes, vol. 86, pp. 95–107, 1988.

Michael L. Gross, et al., *Triple Analyzer Mass Spectrometry For High Rosulution MS/MS Studies*, International Journal of Mass Spectrometry and Ion Physics, vol. 42, pp. 243–254, 1982.

G. L. Gilsh, et al. *Collision Region for Mass Spectrometry/Mass Spectrometry*, Analytical Chemistry, vol. 54, pp. 842–843, 1982.

Johann M. Grundwürmer, et al., *High–resolution mass spectrometry in a linear time–of–flight mass spectrometer*, International Journal of Mass Spectrometry and Ion Processes, vol. 131, pp. 139–148, 1994.

C.R.C. Wang, et al., *Determination of laser beam waist using photoionization time–of–flight mass spectrometer*, vol. 65, pp. 2776–2780, Sep. 1994.

Robert W. Brown, et al., *Mass Resolution Improvement by Incorporation of Pulsed Ion Extraction in a Matrix–Assisted Laser Desorption/Ionization Linear Time–of–Flight Mass Spectrometer*, vol. 67, pp. 1998–2003, Jul. 1, 1995.

*Primary Examiner*—Jack I. Berman

[57] ABSTRACT

The invention relates to methods for the structural analysis of large substance molecules, preferably of chain molecules such as peptides for example, by scanning daughter or fragment ion mass spectra in time-of-flight mass spectrometers with reflectors. The invention consists in the differentiation between daughter ions from spontaneous fragmentations of ions by high-energy collisions and those from delayed fragmentations of metastable ions, by separately detecting the different kinds of ions using a special electrostatic energy filtration by a short Einzel lens directly behind the collision zone. Spontaneously decomposing ions leave the fragmentation zone with smaller kinetic energy due to the loss of mass. Daughter ions from spontaneous decompositions on the one hand, and from metastable decompositions on the other, display characteristic differences which can be used for the determination of structure. Spontaneously decomposing peptide ions preferably show, for example, simultaneously occurring fragmentations of the main and side chains on the then terminal links, while metastable decompositions display no fragmentations of the side chains. In this way, for example, it can be distinguished whether the terminal amino acid is leucine or isoleucine, even though both amino acids have the same mass.

12 Claims, 3 Drawing Sheets

METHOD FOR TIME-OF-FLIGHT MASS SPECTROMETRY OF DAUGHTER IONS

BACKGROUND OF THE INVENTION

1. Field of the Invention

The invention relates to methods for the structural analysis of large substance molecules, preferably of chain molecules such as peptides for example, by scanning daughter or fragment ion mass spectra in time-of-flight mass spectrometers with reflectors.

2. Description of the Related Art

For the gentle ionization of large molecules, i.e. for the generation of molecular ions with only very minimal amounts of fragmented ions, several methods have become known in recent years. The electrospray (ESI=electrospray ionization) generates analysis substance ions out of the solution in air at atmospheric pressure, and the ions can then be transferred into the vacuum system of a mass spectrometer. Matrix assisted laser desorption ionization (MALDI) generates the ions in a vacuum by bombarding substances embedded in tiny matrix crystals on a sample support with light pulses from a laser. Both types of ionization have been applied in conjunction with several types of mass spectrometers, such as quadrupole mass spectrometers, magnetic sector field instruments or time-of-flight mass spectrometers, although there are especially preferred pairings, for example, MALDI with time-of-flight spectrometers.

However, knowledge of the molecular weight is not sufficient for the structural analysis of ions. It requires more extensive information which can be obtained via reactive changes in the ions. Such structural analyses can be concerned with various aspects; attention is here directed primarily toward the sequential analysis of larger chain molecules, for example peptides or proteins. A particularly important reaction for this is the monomolecular decomposition of ions brought about by the introduction of energy into the bonding and oscillation system of the ionized molecules.

The energy for monomolecular decompositions can be introduced into an ion in many ways through collisions with molecules, photons or electrons: individual high-energy collisions with collision gas molecules, a multitude of low-energy collisions with a portion-wise collection of energy in the oscillation system of the ion, bombardment with photons of various wavelengths and densities, or bombardment with electrons of different energy can trigger the decomposition. The decomposition can therefore also take place in a wide variety of ways: immediate ("spontaneous") decompositions without a mass spectrometrically recognizable decay time, but also "metastable" decompositions with a measurable decay time have been observed. The decompositions described here as "spontaneous" must have decay times less than 10 to 100 nanoseconds, then they are no longer recognizable mass spectrometrically without taking special measures.

It has been known for quite some time that daughter ion spectra from high-energy collisions in the range of 10 to 30 keV appear somewhat differently than those from low-energy collisions in the range of 1 to 100 eV. There are however differing opinions regarding quality and significance of the differences. The differences are essentially codetermined by the mass spectrometers used, since the mass spectrometers are not themselves adjusted for distinguishing between spontaneous decompositions and metastable decompositions after leaving the collision chamber, but nevertheless influence the relative mix ratio of the ions from spontaneous and from metastable decompositions in the spectrum.

For several years in time-of-flight spectrometry, the so-called PSD method for scanning of daughter ion spectra from MALDI ions of large molecules has been applied (PSD="post source decay"). In the vaporization cloud of the laser bombardment, so many low-energy collisions are taking place that many of the ions formed become metastable. In addition, a certain amount of thermal energy is stored in the molecular ion and contributes to metastability.

In addition to the formation of metastable ions, one can very favorably introduce collision cells into time-of-flight spectrometers which contribute to the fragmentation of ions.

In the mass spectrometry of peptides and proteins, a unique system of nomenclature has been created for the formation of daughter ions from the molecules. Accordingly, the fragmentations between various groups of amino acids along the main chain are designated by A, B and C if this concerns N-terminal ions. A, B and C designate the three possible fragmentations C-CO, CO-N and N-C of the main chain within an amino acid or between one amino acid and the subsequent one. An index on the letters A, B and C designates the number of the amino acid when counting down the chain. For C-terminal ions, the same fragmentations are designated by X, Y and Z. For fragmentations of the side chains, which are not possible for all amino acids, the designation D for N-terminal ions and W for C-terminal ions has established itself. For example, the D ion of leucine is 42 mass units smaller than that of the A ions, and the D ion of isoleucine is 28 mass units smaller.

If the spontaneous and the metastable ions can successfully be separated, the D ions formed can more easily be recognized and therefore one can differentiate, for example, between terminal leucine and isoleucine, which is not possible in principle on the basis of fragmentations A, B, C, X, Y, and Z. The fragmented ions which result from partial loss of terminal side chains are therefore especially important analytically.

It is an object of the invention to find a method which allows spontaneously generated daughter ions and delayed metastable resulting daughter ions to be measured separately. The invention should make it possible, for example, to recognize and measure D and W ions. It should further be possible to measure even the metastable granddaughter ions of the spontaneously formed daughter ions without any interference.

SUMMARY OF THE INVENTION

It has been established through analysis that the fragmentation mechanisms of the PSD method for chain molecules such as peptides or proteins and those mechanisms from collisions of 30 keV ions in the collision cell are considerably different from one another. These differences are hardly visible with the usual methods for scanning of daughter spectra; indeed for most substances they do not appear visibly at all in the spectrum.

With the PSD method, the large molecules gather internal energy through many low-energy collisions within the expanding vapor cloud of the matrix, which is stored in the form of oscillation energy of a very wide variety of oscillation systems present in the molecule. Given the strongly coupled oscillations of the molecular systems, the energy distribution changes subsequently in a constant and almost random manner; if an excess rise in energy density occurs at one location on the chain molecule, this can lead to a fragmentation here. For the most part only fragmentations of the main chain are generated in this way. Fragmentations of short side chains are practically never observed. The fragmentations also do not occur immediately; the ionized molecules show monomolecular decomposition rates with time constants of many microseconds. The molecule therefore decomposes during its passage time through the time-of-flight mass spectrometer.

In contrast, the high-energy collisions between a highly accelerated molecular ion of 10 to 30 kev kinetic energy and a semi-static collision gas molecule in the collision cell have a different effect. Here, a hard, central impact generally leads to spontaneous fragmentation of the molecule. (Not all collisions of high-energy ions are hard and central; even by high-energy collisions, metastable ions are formed). The spontaneously occurring fragmentations mainly concern side chains and main chains simultaneously. Due to a fragmentation mechanism which has not yet been completely clarified, side chain and main chain of a single amino acid molecule break simultaneously during spontaneous fragmentations. In this process, dependent on the structure, only a characteristic part of the side chain is split off.

The present invention separates the ions which decompose spontaneously at the location of the fragmentation collisions from the ions decomposing metastably later using an energy filter located immediately after the fragmentation cell, and to utilize this separation for a recognition and measurement of the various types of daughter ions. The decomposition of ions is always associated with the loss of a neutral fragment, whereby both fragments essentially retain the same velocity. The kinetic energy is therefore divided up during the fragmentation in proportion to the masses, and the altered kinetic energy of the fragment ions can be used for recognizing the spontaneously decomposing ions. The ions decomposing metastably in the area beyond the energy filter still have their original energy in the energy filter.

This energy filtering can practically be attained through any electrically deflecting field in conjunction with location or angle selection for the deflected beam. A short deflection capacitor can be used for example in connection with a small, energy selecting slit which is positioned in the further course of the flight path. The same selection is also possible through a detector with small detection area at the end of the flight path of the mass spectrometer. However, the deflection capacitor usually is not very short, and a considerable portion of the metastable ions may already decay before or within the capacitor.

Instead of the deflecting capacitor, an electrostatic Einzel lens can be used if the ion beam is shot divergently into the fragmentation zone. The Einzel lens causes an energy-dependent focusing of the beam. Through a small aperture, those ions can then be selected whose energies generate a focal spot for its ion beam within the aperture. Instead of the aperture, a small area detector can be used.

The energy filtering must take place immediately after the spontaneous decomposition, otherwise a part of the metastably decomposing ions is included in the measurement. For an ion beam this means that the electrostatic deflection for the energy filtering must be attached immediately next to the fragmentation zone. "Immediately next to" means only a few centimeters spacing between the collision cell and deflection unit, and the deflection unit should itself also be kept short. Here the rule applies that the spacings can be somewhat larger for a fast beam with ions which were accelerated to 30 kilovolts, than for a slow beam made up of 6 kV ions. The shorter the spacing, the cleaner the spontaneously generated ions are measured.

The deflection unit should itself also not be too long, as otherwise too much mixing with metastable decomposing ions can occur. Here a favorable design is a strong, short Einzel lens, in conjunction with a previously divergent ion beam, even if the Einzel lens is not a completely "clean" energy analyzer since "false" ions from the axial beam are never masked out. The Einzel lens can be made extremely short, and can be placed adjacent to the collision cell. In the extreme, the Einzel lens can be part of the collision cell.

The energy can be filtered, for example, through the width of the aperture opening or the size of the detector, more or less strongly selective of energy. Precise energy selectivity with a high energy resolution means that only those ions are measured whose energy fraction corresponds exactly to the mass ratio of daughter-to-parent ion. Therefore only one single daughter ion from the entire spectrum of spontaneously formed daughter ions is measured.

It is now a further basic idea of the invention to utilize this type of precise energy filtering to also measure the grand-daughter ions, which are formed by further metastable decomposition of selected spontaneously generated daughter ions, in the known and usual manner with the reflector. This measurement constitutes an MS/MS/MS-measurement according to the usual nomenclature.

If on the other hand the energy is filtered only weakly, it is thus possible to measure a larger section of the spectrum of spontaneous daughter ions all at once. With several overlapping measurements, such as are already usual for the PSD spectra in time-of-flight mass spectrometry for example, the entire spectrum of the spontaneously formed daughter ions can be measured in this way with only a few scans.

The arrangement of energy filters as described here is considerably different from the arrangements which one normally uses for tandem mass spectrometry, even if electrostatic deflection fields are also used, as is often usual for magnetic sector fields. Tandem mass spectrometers are normally used for measurement of daughter ions spectra. In tandem mass spectrometry with sector field units, in which two mass spectrometers are connected one after another, the collision chamber is usually arranged at the location of the outlet gap from the first spectrometer which is identical to the entrance gap for the second mass spectrometer. Then there are however long, straight paths after the collision chamber in which the metastable decompositions of such molecules take place which have undergone less intensive collisions in the collision chamber or are already metastable because of their generation itself. The ions thus formed mix inseparably with the spontaneously formed ions and, since the metastable ions far outnumber them as a rule, the spectrum is usually dominated by the metastable ions. The spontaneously formed ions often make up only very small, often hardly discernible signals in the spectrum.

Tandem mass spectrometers with quadrupole filters are usually not well suited to the present purpose, since they do not allow for any very high-energy collisions. Intermediate accelerations of 30 or 100 volts, as are usual in so-called "triple-quads", are not sufficient for the type of special fragmentations of interest here. It is now a further basic idea of the invention to make the spontaneously formed ions-in the case of peptide ions, those with loss of side links—especially recognizable by scanning two daughter ion spectra under varying conditions in each case. For example, one can scan two consecutive spectra with varying voltages of deflection elements, perhaps with two varying lens voltages. Or one can adjust the lens to the preferred imaging of collisionally induced ions and scan two spectra with and without the feeding of collision gas. As a result, both spectra display a strong change in the intensity of some ionic types, and these ionic types are exactly the ions sought after, which result from loss of the side chains.

In the following the application of MALDI ion sources and time-of-flight mass spectrometers is gone into especially closely. For this arrangement, the application of a lens seems an obvious choice if the ion source itself is operated without a grid and therefore supplies a slightly divergent ion beam which must be refocused through an Einzel lens. Here it is particularly favorable to arrange the collision cell directly in front of the lens of the mass spectrometer, and to use the lens for the selection of ions. By adjusting the lens voltage, and thereby also the energy-dependent focal width of the lens, exactly those ions which were fragmented in the collision cell can now be imaged on the detector.

It is a further basic idea not to use a narrowly limited collision chamber which must generally be operated with differentially working pump systems, but rather to arrange an output nozzle for the collision gas near the flight path and only feed it with gas in pulses at the same rate as the desorption laser. This design is associated with low production costs, and short spacings between the collision area and lens can be realized. Most commercial time-of-flight spectrometers are already divided into separately pumped vacuum chambers for the ion source and time-of-flight path, so that the flight path is not overloaded with collision gas.

Of course, similar arrangements can be used, if the fragmentation is not brought about by a neutral collision gas, but rather by photons from a laser beam or by electrons from an electron source.

DESCRIPTION OF THE FIGURES

1=electrically conductive sample support at high-voltage potential
2=intermediate electrode with switched potential
3=base electrode at ground potential
4,6=outer electrodes of the Einzel lens, both at ground potential,
5=center electrode of the Einzel lens, at lens potential,
7=focusing lens for the laser light pulse,
8=beam of the laser light pulse,
9=sample substance on the sample support,
10=gridless aperture in the intermediate electrode,
11=gridless aperture in the base electrode,
12=ion beam defocused through the apertures and focused through the lens,
13=observation field of view,
14=observation mirror,
15=observation lens,
16=ion beam in the flight tube of the time-of-flight mass spectrometer
17=feeder tube for a collision gas with nozzle
18=feeding of the collision gas
19=collision gas cloud

DETAILED DESCRIPTION OF THE PREFERRED EMBODIMENTS

Figure 1:
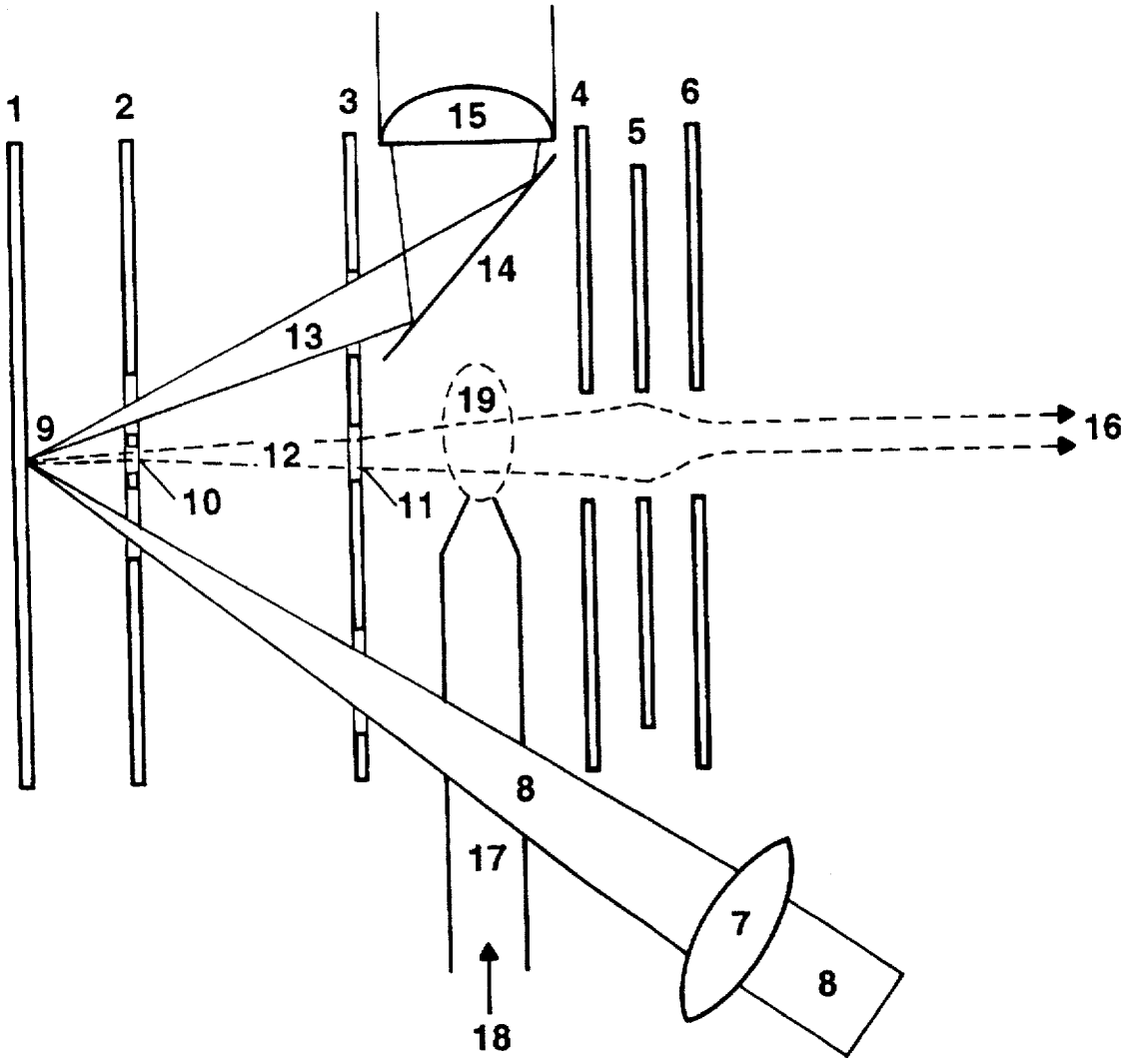
FIG. 1 shows a MALDI ion source for the method of detection of spontaneously formed fragmented ions with collision zone and Einzel lens. The figure has the following elements.
Figure 2:
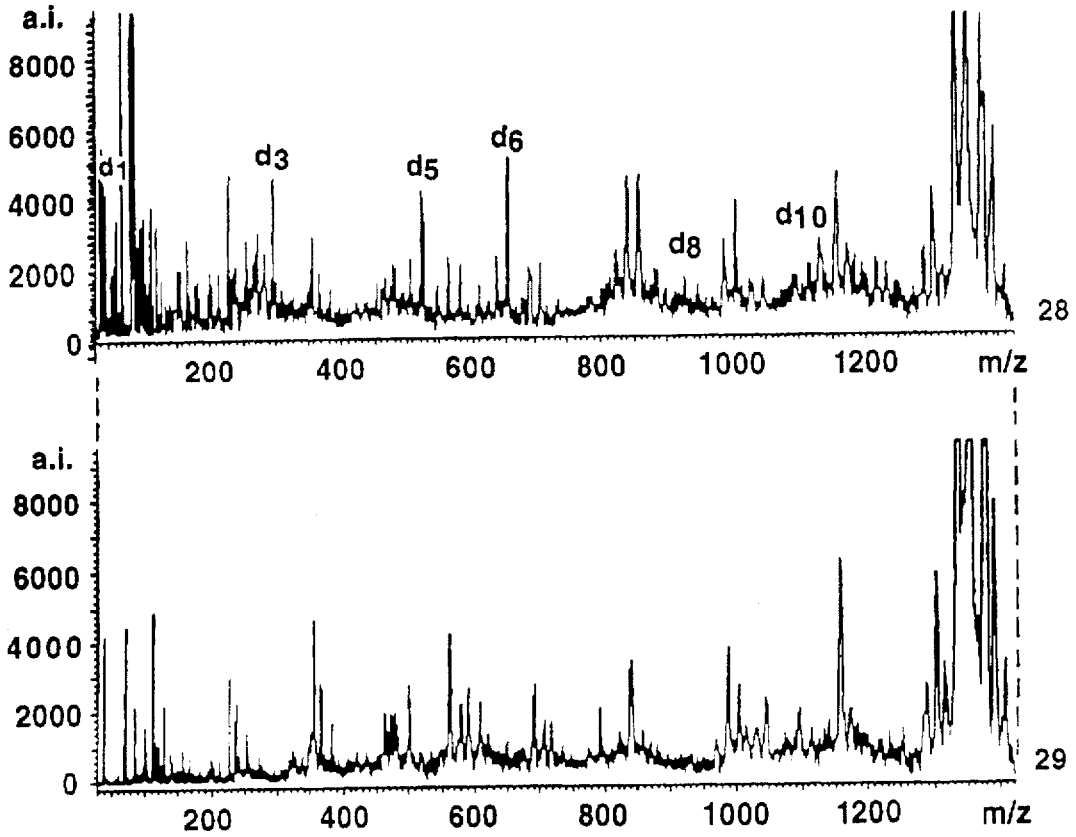
FIG. 2 shows two daughter ion spectra 28 and 29 from a peptide called "Substance P" measured according to this invention. Spectrum 28 of spontaneously formed exhibits the D ions, seen here in some areas of the spectrum (except in the molecular ion region) as the strongest ions. The $D_2$, $D_4$ and $D_9$ ions are lacking because they cannot be formed (their amino acids, prolin and glycine, possess no side chains or none which are splittable). The $D_7$ and $D_8$ ions are unfavorably affected in their formation since this concerns side phenyl chains. Spectrum 29 reproduces the PSD spectrum of the metastably decomposing ions, which looks significantly different. The D ions are not present here at all. It should just be mentioned that all ion types which turned up here can be identified.
Figure 3:
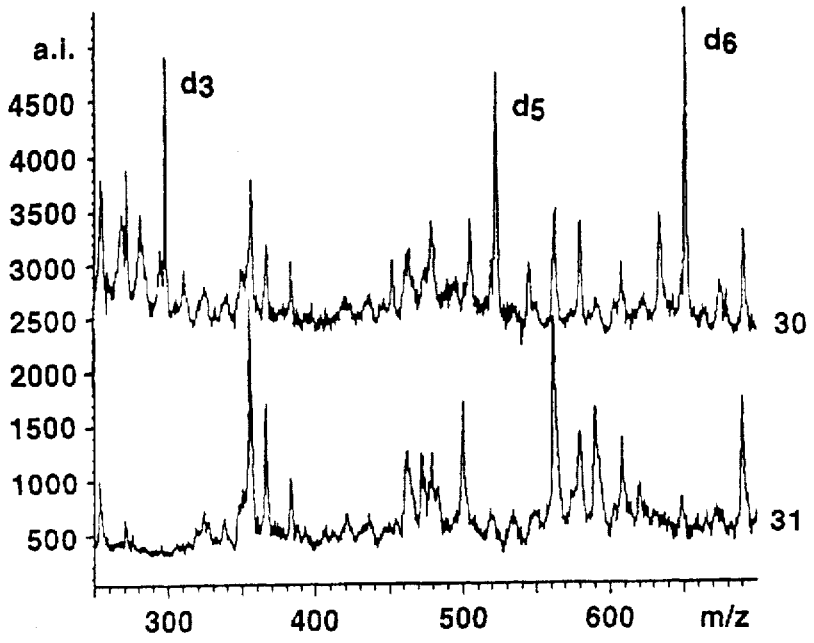
FIG. 3 shows, in spectra 30 and 31, a section from both of the above spectra with $D_3$, $D_5$ and $D_6$ ions.

A favorable embodiment of an ion source for a time-of-flight mass spectrometer with apparatuses according to this invention is shown schematically in FIG. 1. The sample substance 9 is applied together with a matrix substance in the form of thin crystal layer onto the surface of a metal sample support 1. The sample support can be introduced through a vacuum lock into the vacuum of the mass spectrometer and brought automatically into contact with the high-voltage feeder (not shown). The sample support can be pushed using a motion device (not shown) parallel to its sample surface, and in this way several sample substances 9 can be applied and analyzed one after another.

Besides the sample support 1, the ion source consists of the intermediate electrode 2, the potential of which is switched with a delay using a known method for improvement of the mass resolution in the daughter ion spectra, and also of a base electrode 3, which is at the same potential as the flight tube. The total acceleration voltage amounts usually to about 30 kilovolts. The flight tube (not shown) encompasses the flight path of the time-of-flight spectrometer. It is generally at ground potential. At the start of the flight path, relatively close to the base electrode, an Einzel lens is attached which consists of a front electrode 4, terminating electrode 6, both at the same potential as the flight tube, and of the center electrode 5 at lens potential.

The potential between sample support 1 and intermediate electrode 2 can be switched off for a brief time during the expansion process of the vaporization cloud to improve focusing, but also to avoid collisions of ions with the molecules of the vaporization cloud, so that in this way the generation of metastable ions (so-called PSD ions) can be entirely suppressed or at least reduced.

According to this invention, a feeding tube 17 for the collision gas juts into the small intermediate area between the base electrode and lens, with a nozzle at the end of the feeding tube which is located near the flight point of the ion beam. Feeding of the collision gas can be switched on and off (using a valve not shown). The collision gas is then fed for practical reasons in short-lasting gas batches. Shortly before firing the laser, the pulse valve is opened for as short a time as possible - generally less then a millisecond. In this way, the pump system is barely loaded by the collision gas. When in the following, a spectrum is scanned "while feeding collision gas", this pulse-like feed is always meant.

While feeding collision gas, daughter ion spectra are now scanned which can be displayed on a monitor of the control computer. When so doing, then the lens voltage is adjusted in such a way that the selected ions which were recovered through the splitting off of a side chain demonstrate a relative maximum of intensity. This setting is best made with a substance whose fragmentation response is known and, for example, a D-ionic type is then observable which results from spontaneous splitting off of a side chain in conjunction with a main chain fragmentation.

With this optimal lens voltage, two daughter ion spectra each are now scanned, whereby collision gas is fed for one spectrum and not for the other. The differences in intensity in these spectra immediately indicate those ions which have been generated by fragmentation of side chains.

As is generally known, the scanning of a complete daughter ion spectrum in a time-of-flight mass spectrometer is made up of single sections. Each partial scan is generated by a different setting of the reflector. For these partial scans, it is therefore important that the voltage of the lens be adjusted proportionally to the voltage of the reflector. This can be done very easily by the digital control on the time-of-flight spectrometer.

When using the present invention, it is possible to adjust the lens voltage between each of the two scans. As a result, the collision gas feed can remain switched on in order to allow all scanning parameters to remain consistent. However the feeding of collision gas can also be omitted for spectra which are not required to show any side chain splitting off.

Figure 4:
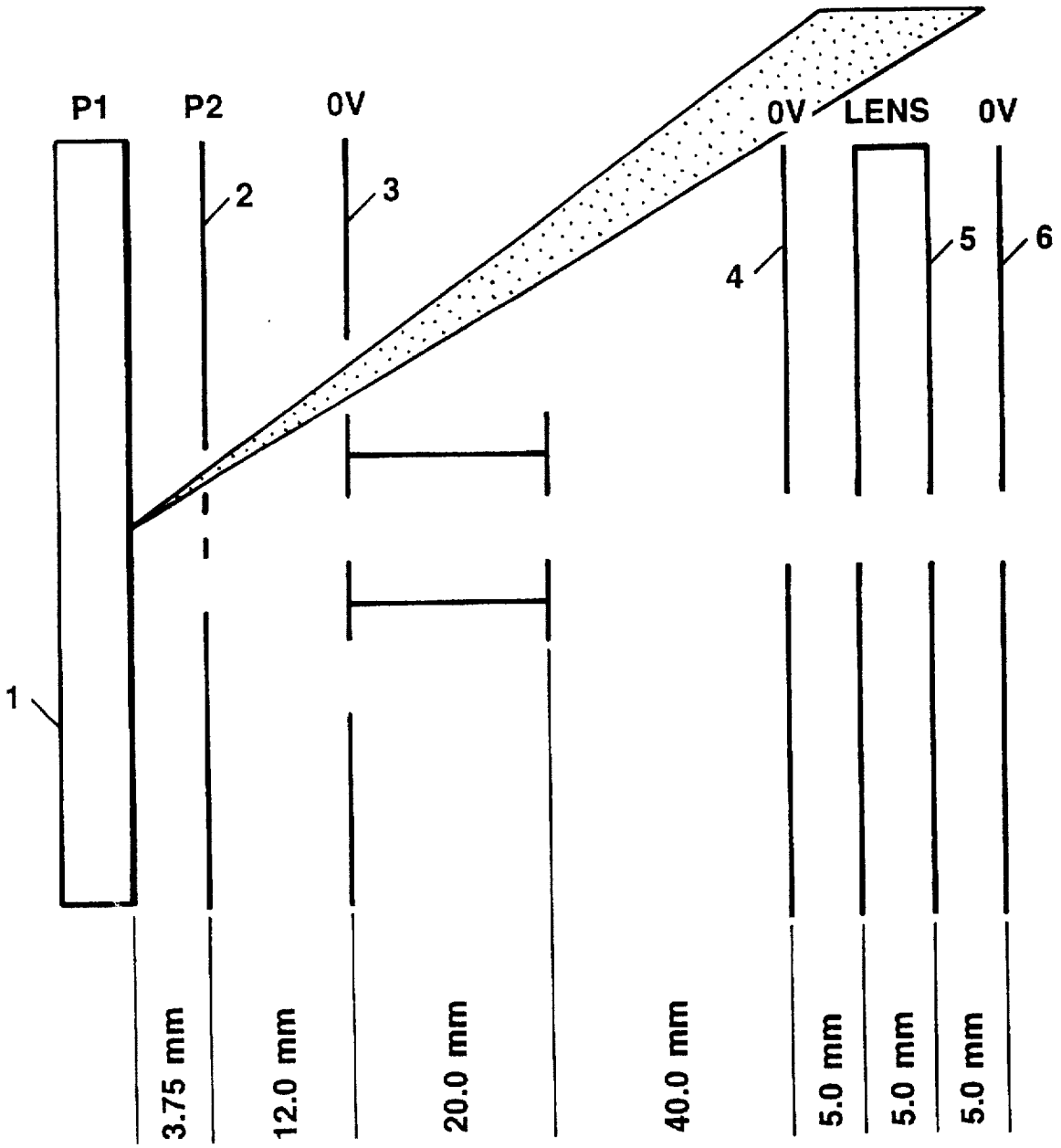
FIG. 4 shows the arrangement of elements used to generate the spectra of FIG. 3.

An example of the present invention is demonstrated in conjunction with FIG. 4. The system may be operated in either PSD-mode or CID-mode. The separations between the various elements are shown in the figure.

In PSD-mode, sample support 1 is provided with a voltage potential of 28,500 V, and intermediate electrode 2 has a voltage potential of 21,400 V. The reflector of a time-of-flight spectrometer (not shown) used with this arrangement should have a voltage which is changed for each of a plurality of different daughter ion ranges. For example, ten ranges used in the example of FIG. 4 might require ten different reflector voltages between 950V and 30,000V. Other voltages include base electrode 3, which is at a potential of 0V, and an Einzel lens which consists of thick center aperture 5, at a constant potential of 10,000V, and thin front aperture 4 and end aperture 6 each at a potential of 0V. In this mode, the pressure in the flight tube is $3\cdot10^{-7}$ mbar, and a delay of 75 ns is used between the time of the laser light pulse and the switching of the acceleration field between sample support 1 and intermediate electrode 2. In a variation of this example, no delay is used, and the parameters are the same as those described above, except for the potential of the sample support, which is preferably 25,000V.

Referring again to FIG. 4, the system may also be operated in CID-mode. The following is an example of parameters which may be used in CID-mode. The potential of the sample support 1 is 28,500V and the potential of the intermediate electrode 2 is 23,000V. As in PSD-mode, the spectrometer reflector uses a range of voltages between 950V and 30,000V. Base electrode 3 is at a potential of 0V, and the Einzel lens center aperture 5 has a voltage which varies with the different daughter ion ranges, and is equal to one-third of the reflector voltage. The front aperture 4 and end aperture 6 of the Einzel lens are again each at a potential of 0V. The pressure in the flight tube is $3\cdot10^{-6}$ mbar, and a delay of 75 ns is used. If no delay is to be used, the only difference in the above voltage potentials is that the intermediate electrode is at 26,000V. In both PSD and CID modes, the use of delayed acceleration produces a better mass resolution.

While the invention is shown and described with reference to a preferred embodiment thereof, it will be recognized by those skilled in the art that various changes in form and detail may be made therein without departing from the spirit and scope of the invention as defined by the appended claims. For example, it is possible for a specialist in the development of mass spectrometers to install the energy filtering in other types of mass spectrometers with the information given here regarding the idea of the invention. As a result, there are many other arrangements possible which reflect the basic idea of using immediate energy filtration to prevent the spontaneously resulting ions from becoming mixed with larger amounts of metastable ions.

What is claimed is:

1. Method for the structural analysis of ions with a time-of-flight mass spectrometer by measuring daughter ions which are generated from a beam of said ions in a fragmentation zone by high-energy collisions with gas molecules, wherein:

(a) the ions enter the fragmentation zone as a divergent ion beam, not focused onto the ion detector, and (b) a short Einzel lens adjacent to the fragmentation zone focuses the spontaneously decaying ions, having lower kinetic energies than the yet unfragmented ions, onto the ion detector, thus selectively favouring these daughter ions to be detected compared with those of metastable decays taking place lateron in the mass spectrometer.

2. Method as in claim 1, wherein a time-of-flight mass spectrometer with a matrix-assisted laser desorption and ionization (MALDI) ion source is used.

3. Method as in claim 2, wherein the divergence of the ion beam is generated by the effect of the lateral velocities the ions gain in the MALDI process.

4. Method as in claim 3, wherein the divergence of the ion beam is increased by the slightly defocusing effect of an ion source with gridless apertures.

5. Method as in claim 1, wherein an ion reflector analyzes the energy of ions, thereby scanning the daughter ion spectra in a well-known manner.

6. Method as in claim 1, wherein the electric acceleration field in front of the sample support can be switched on with a time delay relative to the laser light flash of the MALDI ion source.

7. Method as in claim 1, wherein the fragmentation zone is a collision cell which can be filled with a collision gas in a pressure range of $10^{-3}$ to $10_{-1}$ millibar.

8. Method as in claim 1, wherein the fragmentation zone consists of a collision gas cloud which forms in the vacuum system of the mass spectrometer in front of a gas supplying nozzle.

9. Method as in claim 8, wherein the nozzle is supplying gas in pulses.

10. Method as in claim 1, wherein, in subsequently acquired daughter ion spectra, spontaneously fragmented and unfragmented ions are alternatingly measured by the detector, thus distinguishing spontaneously generated daughter ions from metastably generated ones.

11. Method as in claim 10, wherein the alternating measurements are obtained by changes of the focusing voltage at the Einzel lens.

12. Method as in claim 10, wherein the alternating measurements are obtained by changes of the collisional gas supply.

* * * * *